United States Patent [19]

Shubb

[11] 4,450,744

[45] May 29, 1984

[54] ELECTRIC PICKUP DEVICE FOR A MUSICAL INSTRUMENT SUCH AS A BANJO

[76] Inventor: Richard Shubb, P.O. Box 5311, Berkeley, Calif. 94705

[21] Appl. No.: 382,957

[22] Filed: May 28, 1982

[51] Int. Cl.[3] ..... G10H 3/00

[52] U.S. Cl. ..... 84/1.16; 84/1.14; 84/DIG. 24

[58] Field of Search ..... 84/1.14, 1.16, DIG. 24, 84/269

[56] References Cited

U.S. PATENT DOCUMENTS

| | | | |
|---|---|---|---|
| 3,600,497 | 8/1971 | Zanessi | 84/1.14 |
| 4,213,368 | 7/1980 | Cox | 84/269 |
| 4,314,495 | 2/1982 | Baggs | 84/1.16 |

FOREIGN PATENT DOCUMENTS

| | | | |
|---|---|---|---|
| 1140404 | 1/1969 | United Kingdom | 84/DIG. 24 |

*Primary Examiner*—Forester W. Isen

*Attorney, Agent, or Firm*—Burns, Doane, Swecker & Mathis

[57] ABSTRACT

An electric pickup device for a banjo includes a piezoelectric element located in a recess in the bottom of one foot of the bridge for the instrument, so as to be located at the interface of the bridge and the head. The pickup element can be oriented so that its axes form an angle with the plane of the head, to thereby provide improved results. The pickup enables the banjo to be played in either an acoustic or an electronic amplification mode without affecting the inherent acoustic properties of the instrument.

13 Claims, 5 Drawing Figures

ELECTRIC PICKUP DEVICE FOR A MUSICAL INSTRUMENT SUCH AS A BANJO

BACKGROUND OF THE INVENTION

The present invention generally relates to an electric pickup element for an acoustic musical instrument, and more specifically to such an element that is particularly adapted to convert the musical sounds of a banjo into electrical signals for use in reproduction of those sounds.

The prior art is replete with a large variety of electrical pickup elements that are designed for use in one type of stringed musical instrument or another. However, almost without exception, these pickups are not designed, or well adapted, to be used on a banjo. In large part, they are intended for use on either guitars or musical instruments in the viol family, e.g. violin, cello, bass viol.

A significant reason why electrical pickups designed for instruments such as guitars and violins have not met with success when attempts are made to use them on banjos is based on the substantially different operating characteristics that a banjo has in comparison with these other musical instruments. A major, and perhaps the main, determining factor of the acoustic properties of an instrument like a guitar or a violin is the design of its resonating box. When the strings of such an instrument are plucked, or a bow is drawn across them, the vibrations of the strings are transmitted to the resonating box, typically through a bridge. The vibrations that are induced in the box determine the characteristic sounds of the instrument. An electrical pickup element that is intended for use with an instrument of this type is designed to pick up the vibrations within the resonance box. Typically, the pickup element might comprise a piezoelectric crystal that is attached to one of the walls of the resonance box.

A banjo does not have a resonance box that determines its characteristic sounds. Rather, the banjo includes a taughtly stretched diaphragm that is commonly referred to as the "head" of the banjo. A bridge element rests on the head, and supports the strings. When the strings are plucked, they induce vibrations in the bridge, which are in turn transmitted to the head to produce the desired sounds. In contrast to a number of other stringed instruments, the bridge of a banjo is not permanently secured to the head. It is merely held in place by the tension of the strings. Consequently, when the head vibrates in response to plucking of the strings, there is relative movement and change in tension between the head and the bridge. Thus, there is a different type of interplay between the elements of a banjo that produces its characteristic sounds than is found in other stringed musical instruments.

Early attempts at electrically reproducing the sounds of a banjo involved placing a pickup element in contact with the head to detect its vibrations. One example of a pickup arrangement of this type is disclosed in Law U.S. Pat. No. 3,780,202. This patent discloses a bracket for adjustably positioning an electromagnetic pickup in any of a number of different positions against the back side of the head. Although this arrangement can detect the vibrations of the head, the sound which is ultimately reproduced does not have the same tonal properties as those of a banjo standing alone. One problem with this type of arrangement has been that it is sensitive to feedback. In addition, the pickup element is not sufficiently close to the source of the sound, i.e. the interface between the head and the bridge. This latter factor may account for some of the inaccuracy which appears in the reproduced sounds.

Another drawback associated with the type of pickup arrangement disclosed in the Law patent is that the pressure of the pickup element against the head alters the acoustic properties of the instrument. In other words, the head is not free to vibrate as a whole in response to the motion of the bridge. Rather, some of its movement is dampened by the pickup element, which results in a muffled sound being ultimately produced.

For this very same reason, a number of other approaches, in which the pickup is incorporated into the structure of the bridge, are not considered to be totally successful when used in connection with a banjo. In these systems a piezoelectric element forms a transverse layer of the bridge. Although this type of arrangement can be found in electric guitars, electropianos and the like, it is not desirable for use in an acoustic instrument because it alters the acoustic properties of the instrument. More specifically, by substituting a layer of the piezoelectric material for the wood, plastic or other conventional material of a bridge, a discontinuity is introduced in the bridge and the transmission of vibrations to the sound box or the banjo head is altered. Usually, this alteration results in a dampening of the sound. In effect, the piezoelectric element determines the acoustic tone of the instrument, rather than merely reporting it. Consequently, in those situations in which it is desirable to play an acoustic musical instrument either with or without the use of electronic amplification, while producing the same sounds in either instance, a bridge comprising a layer of piezoelectric material is not suitable.

Other arrangements also utilize a piezoelectric element incorporated in a bridge. Rather than forming a complete layer across the bridge, the transducers are inserted in slots in the bridge, and are placed under constant compression by the bridge structure. Examples of this type of arrangement are disclosed in Crownover U.S. Pat. No. 2,769,867 and Barcus et al U.S. Pat. No. 3,325,580. Again, arrangements of this type result in an alteration of the acoustic properties of the instrument, although not to the same extent as those utilizing a complete piezoelectric layer. The sound which does result is believed to be effected by the artificial stress that is present within the bridge due to the compression of the piezoelectric elements. Furthermore, the piezoelectric elements, by being incorporated somewhere within the middle of the bridge, are not located adjacent the sound source and therefore do not provide the most accurate report of the instrument's sounds.

In addition, each of the various prior art arrangements utilizing a pickup element incorporated in a bridge does not provide acceptable results when used on a banjo, in part due to the previously noted difference in operating characteristics of banjos vis-a-vis other stringed instruments, as well as a result of the location of the transducer on the instrument.

OBJECTS AND BRIEF SUMMARY OF THE INVENTION

It is therefore a general object of the present invention to provide a novel electric pickup arrangement for an acoustic musical instrument that is capable of providing for accurate electronic reproduction of the sounds of the instrument.

It is a more specific object of the present invention to provide a novel electric pickup for an acoustic musical instrument that does not alter the acoustic properties of the instrument when incorporated therein, and therefore enables the instrument to be played in either an acoustic or an electronic amplification mode.

It is another object of the present invention to provide a novel electric pickup for a musical instrument that is incorporated into a conventional bridge element for the instrument and can thereby be easily provided on the instrument by simple substitution of bridges, without further modification of the instrument.

It is a further object of the present invention to incorporate a piezoelectric element into the bridge of a musical instrument in such a fashion that as much as the original path of transmission of the vibrations as possible is left intact, to thereby not adversely affect the acoustic qualities of the instrument.

It is a particular object of the present invention to provide a novel electric pickup for a banjo that achieves all of the preceding objects.

In accordance with these, as well as other objects, the present invention broadly comprises a piezoelectric element that is inserted into a recess in the bottom of one foot of a bridge for a banjo. By being disposed in the bridge in this manner, the pickup element is located as close as feasibly possible to the major sound source, i.e., at the interface of the bridge and the head. In addition, by being located within the bridge, it is directly responsive to the vibrations induced by the strings. However, it does not affect, to any appreciable degree, the acoustic characteristics of the bridge or any of the other banjo structure. Consequently, it can be left in place without adverse effects when the banjo is played only in an acoustic mode.

Further advantages of the invention in connection with both banjos and other acoustic musical instruments will become apparent to those of ordinary skill in the art upon a perusal of the following detailed description of the preferred embodiment of the invention illustrated in the accompanying drawings.

DETAILED DESCRIPTION

Figure 1:
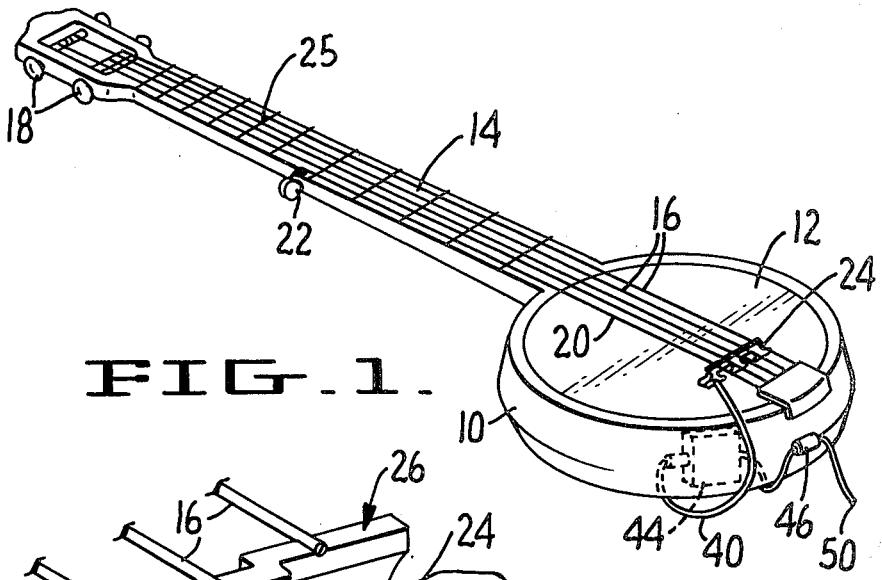
FIG. 1 is a perspective view of a banjo incorporating a pickup element embodying the present invention.
Figure 2:
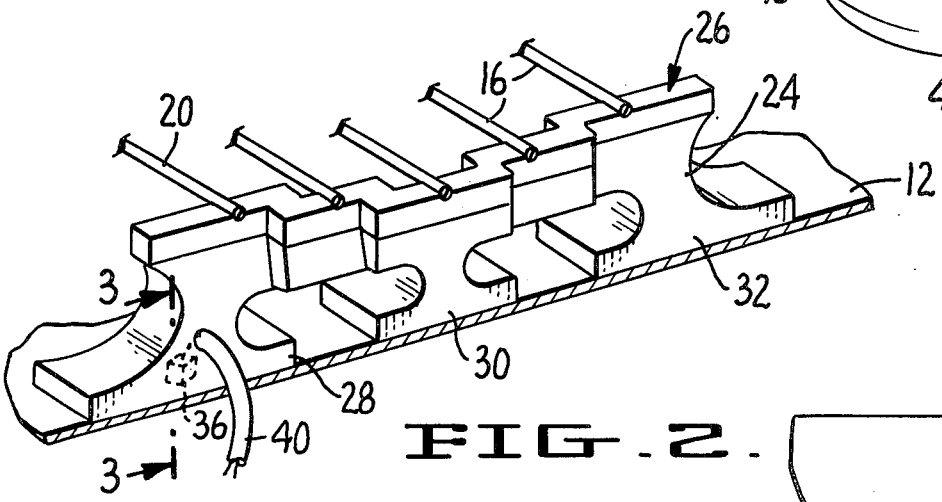
FIG. 2 is a more detailed perspective view of the banjo bridge.

Referring to FIGS. 1 and 2, the basic components of a banjo include a rim 10 which supports the head 12. A neck 14 is attached to, and extends from, one side of the rim. The strings 16 are secured to the opposite side of the rim 10, and extend across the head 12 and along the length of the neck 14, and are secured to the remote end of the neck by rotatable pegs or screws 18 that provide for individual adjustment of the tension of the strings in a well-known manner. The fifth-string 20 of the banjo extends along only a portion of the neck and is secured thereto by means of another adjustable peg 22. Each of the strings 16, 20 is spaced from and supported parallel to the head 12 by means of a bridge 24, which is held in place against the head by the tension of the strings.

During play of the banjo, as each string is plucked it vibrates at a frequency determined by its size and effective length, i.e. the length of the portion of the string between the bridge 24 and the particular fret 25 on the neck 14 against which the player urges the string. These vibrations are induced in the bridge 24, which in turn transmits them to the head 12. The head basically functions as a diaphragm, and the vibrations that are transmitted to and induced in it through the bridge result in the characteristic sounds of the instrument. Since the bridge basically rests on the diaphragm, rather than being permanently fixed thereto, there is relative movement between them during play of the banjo, i.e. the bridge "bounces" on the diaphragm in the sense that there is a fluctuation in the tension at their interface. The vibration of the strings and this relative motion of the bridge and the diaphragm constitute the major sources of sound in the instrument. Consequently, an electric pickup that is designed to accurately report the sound of the banjo should be able to detect both of these sound sources.

Referring to FIGS. 2–5, a bridge 24 that incorporates an electric pickup element in accordance with the preceding principle is illustrated in greater detail. The bridge 24 itself is a conventional banjo bridge comprising an upper horizontal surface 26 on which the strings 16, 20 are supported and three legs 28, 30, 32 that rest against the head 12.

In accordance with the present invention, a recess 34 is provided in the bottom of one of the feet of the bridge, and a piezoelectric transducer 36 is disposed in the recess. In the preferred embodiment of the invention, the recess is provided in the bass foot 28, i.e. that foot of the bridge that is nearest the fifth string 20. It is believed that the material from which the bridge is constructed, e.g. maple wood, transmits higher treble frequencies somewhat better than lower bass frequencies. For this reason, it is desirable to position the transducer 36 close to the source and transmission path of these lower frequency signals to thereby obtain the best balance of input signals to the transducer.

The piezoelectric transducer 36 can be any suitable conventional device of this type. It has been found that a transducer having a cubic shape, with each side having a length of approximately 0.10 inch, works particularly well. However, it will be appreciated that transducers having other shapes will also function effectively.

The recess 34 is preferably milled, or otherwise drilled or cut, into the bottom of the foot 28 so that it is of a size and depth no greater than that which is needed to accommodate the transducer 36. By limiting the size of the recess to be as small as practically feasible, two significant advantages are obtained. First, the minimum amount of bridge material is affected and therefore the original path of transmission of the vibrations is left intact to the maximum extent possible. Secondly, the amount of epoxy or other adhesive material necessary to retain the transducer in the recess is also minimized. Most epoxies commonly employed in this type of application are resilient in character, and therefore tend to dampen the vibrations transmitted to the transducer. By minimizing the amount of this material that surrounds the transducer, the dampening effect is lessened and a more accurate reading of the actual vibrations induced by the strings can be obtained.

Figure 3:
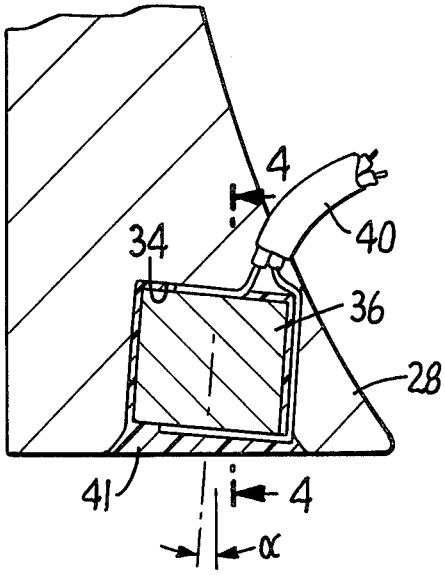
FIG. 3 is an enlarged cross-sectional side view of the banjo bridge.
Figure 4:
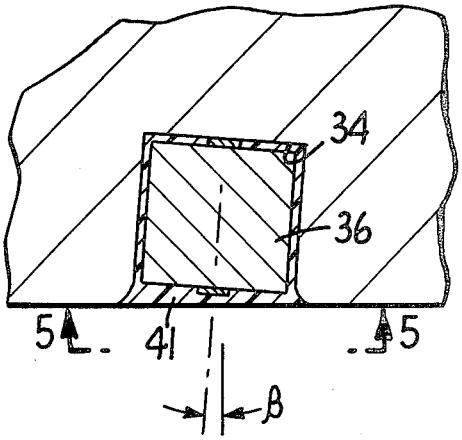
FIG. 4 is an enlarged cross-sectional back view of the banjo bridge.

As an example of a method for constructing the pickup assembly, the recess 34 is provided in the bottom of the base foot 28 of a conventional bridge, to a depth sufficient to accomodate the transducer 34. In this regard, the depth of the recess should be slightly greater than the height of the transducer, so that when the transducer is inserted therein, it will not protrude below the bottom plane of the foot. Thus, the transducer is slightly recessed from the head and not under constant compression when the bridge 24 is inserted in place between the strings 16 and the head 20. In addition to the recess 34, a hole can be drilled in the foot to provide access to the recess from the side of the foot. Two wires forming an output lead 40 are respectively attached to opposite faces of the transducer, in a well-known manner, and the lead can be inserted into the hole from the recess and pulled therethrough to bring the transducer into the recess, as illustrated in FIG. 3. When in place, the two wires of the lead 40 are disposed on the top and bottom surfaces of the transducer.

With the bridge turned upside-down, epoxy 41 can be poured into the recess to secure the transducer in place. As noted previously, the space between the sides of the recess and the transducer is preferably as small as possible, so that a minimal amount of epoxy is present in the recess. Furthermore, with the transducer in direct contact with the bottom of the recess, little or no epoxy lies between the transducer and the bridge. It is believed that this factor contributes to the accuracy of the sounds that are reproduced, since there is less dampening of the vibrations imparted to the transducer.

Once the epoxy is hardened, any excess is filed away so that it is flush with the bottom of the foot 28.

Figure 5:
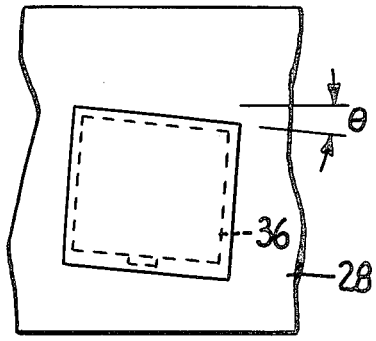
FIG. 5 is a bottom view of a portion of the banjo bridge.

In a preferred form of the invention, the transducer is oriented within the recess so that its central axes are at angles with respect to the plane of the head 12. Thus, referring to FIGS. 3 and 4, the transducer 36 is tilted from both the side and front views so that its axis 42 through its top and bottom surfaces forms angles $\alpha$ and $\beta$ with planes normal to the surface of the head. Similarly, as illustrated in FIG. 5, the transducer is turned about its axis 42 so that the side surfaces of the cube form an angle $\theta$ with the longitudinal direction of the strings, when viewed from below.

It has been found that good results are obtained with an angle of tilt of up to about 20° along each axis of the transducer. Best results have been observed when the angle is in the range of 5° to 10° for each axis, rather than parallel to the plane of the head and the two planes that are normal to the head and respectively parallel to and normal to the direction of the strings.

When so constructed, the bridge incorporating the piezoelectric element can be substituted for the conventional bridge on a banjo. This action does not require any structural modification of the banjo, since it normally utilizes replaceable bridges. In this sense, the invention can be considered to be modular in nature, since it only requires substitution of one removable element for another.

The two wires of the output lead 40 can be connected to a conventional amplifier and speaker circuit for electronically reproducing the sounds of the banjo. Due to the small magnitude of the signals that are obtained with the piezoelectric crystal, a preamplifier may be required to initially boost the signal before it is applied to the amplifier. In this regard, a small preamplifier circuit 44 that is tuned to the frequencies of the particular sounds of a banjo can be mounted on the instrument. For example, it can be mounted on the inside of the rim 10 of the banjo, beneath the head. The output lead 40 can plug into the input side of the preamplifier circuit. The output terminal of the preamplifier circuit is connected to a jack 46 mounted on the rim that can be connected to a lead 50 that goes to a conventional amplifier and speaker system.

From the foregoing it will be appreciated that the present invention provides a simple, yet effective, electronic pickup for a banjo. The piezoelectric element is located at the source of sound for the instrument, and thereby provides the most reliable detection of the banjo's characteristic sounds. By locating the pickup in one foot of the bridge for the banjo in the manner described previously, the natural acoustics of a banjo are only minimally effected, thereby enabling the banjo to be played in either an acoustic or an amplification mode with accurate tone reproduction. In effect, the transducer moves with the vibrations of the bridge that are induced by both the strings and the head, rather than being used to transmit the vibrations to the head.

The present invention can be embodied in other froms without departing from the sprit or essential characteristics thereof. For example, although the preferred form of the invention has been disclosed in connection with a banjo, it will be appreciated that its underlying principles are also applicable to other acoustic musical instruments that have interchangeable bridges which are not permanently affixed to the instrument, and therefore operate in a manner somewhat analogous to a banjo. The presently disclosed embodiment is therefore considered in all respects to be illustrative and not restrictive. The scope of the invention is indicated by the following claims rather than the foregoing description, and all changes that come within the meaning and range of equivalents of the claims are therefore intended to be embranced therein.

What is claimed is:

1. A bridge element and electric pickup for use in a banjo, comprising:

a support element having a support surface for engaging and supporting the strings of a banjo, and a plurality of feet on the side of said element oposite said support surface for resting against the head of a banjo;

a recess within one of said feet open only to the bottom of said one of said feet;

a piezoelectric pickup element disposed in said recess substantially near the bottom of said foot to be proximate to the head; and means for connecting said pickup element with a circuit for receiving output signals from said element and converting them into audible sounds.

2. The bridge element of claim 1, wherein said pickup element has two opposing flat surfaces, and is oriented in said recess so that an axis normal to said surfaces intersects the plane of the bottom of said foot at an acute angle.

3. The bridge element of claim 2 wherein said acute angle is in the range of 70°–85°.

4. The bridge element of claim 1, 2 or 3 wherein said pickup element is in the shape of a cube, and the axes normal to its side faces intersect the plane of the bottom of said foot at acute angles.

5. The bridge element of claim 4 wherein said acute angles are each in the range of 5°–20°.

6. The bridge element of claim 1 wherein said piezoelectric element is in direct contact with one surface of said recess.

7. The bridge element of claim 1 wherein said pickup element is recessed from the bottom plane of said foot.

8. The bridge element of claim 1 wherein said foot is the foot adapted to be disposed closest to the bass string of a banjo.

9. A banjo, comprising:

a base portion including a flat head supported on a ring;

a neck attached to one side of said rim;

a plurality of strings extending across said head and at least partially along the length of said neck;

a bridge comprising a plurality of feet disposed between said head and said strings to support said strings in spaced parallel relation to said head;

a piezoelectric element disposed in a recess within one of said feet, said recess open only to the bottom of said bridge so as to be proximate the interface of said bridge and said head; and means for connecting said piezoelectric element with a circuit for amplifying electrical signals produced by said element and converting them into audible sounds.

10. The banjo of claim 9 wherein at least one axis normal to a face of said piezoelectric element intersects said head at an acute angle.

11. The banjo of claim 9 wherein said piezoelectric element is in direct contact with one surface of said recess.

12. The banjo of claim 9 wherein said piezoelectric element is out of contact with said head.

13. A combination bridge and electric pickup assembly for use in an acoustic stringed musical instrument, comprising:

a bridge element having a support surface for engaging and supporting the strings of the instrument, and a plurality of feet on the side of said element opposite said support surface for engaging the body of said instrument; only a recess within one of said feet open to the bottom of said one of said feet;

a piezoelectric element disposed in said recess proximate the bottom plane of said foot; and means for connecting said pickup element to a circuit for converting electrical signals from said pickup element into audible sounds.

* * * * *